US007487829B2

(12) United States Patent
McDonald et al.

(10) Patent No.: US 7,487,829 B2
(45) Date of Patent: Feb. 10, 2009

(54) WELLBORE VALVE HAVING LINEAR MAGNETICALLY GEARED VALVE ACTUATOR

(75) Inventors: William J. McDonald, Houston, TX (US); Timothy F. Price, Rockwall, TX (US)

(73) Assignee: Dexter Magnetic Technologies, Inc., Elk Grove Village, IL (US)

( * ) Notice: Subject to any disclaimer, the term of this patent is extended or adjusted under 35 U.S.C. 154(b) by 7 days.

(21) Appl. No.: 11/762,929

(22) Filed: Jun. 14, 2007

(65) Prior Publication Data

US 2007/0289734 A1 Dec. 20, 2007

Related U.S. Application Data

(60) Provisional application No. 60/815,129, filed on Jun. 20, 2006.

(51) Int. Cl.
*E21B 34/12* (2006.01)
*F16K 31/10* (2006.01)

(52) U.S. Cl. ..... 166/66.7; 166/66.5; 166/332.1; 166/332.8; 251/65

(58) Field of Classification Search ..... 166/381, 166/386, 66.5, 66.6, 66.7, 332.1, 332.8; 251/65, 251/129.01, 129.06
See application file for complete search history.

(56) References Cited

U.S. PATENT DOCUMENTS

| | | | | |
|---|---|---|---|---|
| 2,536,813 | A * | 1/1951 | Jones et al. | 251/65 |
| 2,746,395 | A * | 5/1956 | Carpenter | 417/111 |
| 6,713,944 | B2 * | 3/2004 | Omata et al. | 310/328 |
| 2003/0155131 | A1 * | 8/2003 | Vick, Jr. | 166/375 |
| 2008/0157014 | A1 * | 7/2008 | Vick, Jr. et al. | 251/65 |

FOREIGN PATENT DOCUMENTS

EP 436214 A1 * 7/1991

OTHER PUBLICATIONS

Atallah, K. et al., "A high-performance linear magnetic gear", Journal of Applied Physics 97, 10N516 (2005).
Rizk, J. et al, "Analysis and design of magnetic torque couplers and gears" (publisher and date unknown).

* cited by examiner

*Primary Examiner*—Kenneth Thompson
(74) *Attorney, Agent, or Firm*—Richard A. Fagin

(57) ABSTRACT

A wellbore valve includes a valve operator arranged to move axially along an interior of the wellbore, the valve operator arranged to operate a valve. A valve actuator is disposed proximate the valve operator. The valve actuator is arranged to move from one longitudinal position to another. A linear magnetic gear is coupled at an input element thereof to the valve actuator. The gear is coupled at an output element thereof to the valve operator such that motion of the valve actuator is transferred to the valve operator.

20 Claims, 5 Drawing Sheets

WELLBORE VALVE HAVING LINEAR MAGNETICALLY GEARED VALVE ACTUATOR

CROSS-REFERENCE TO RELATED APPLICATIONS

Priority is claimed from U.S. Provisional Application No. 60/815,129 filed on Jun. 20, 2006

STATEMENT REGARDING FEDERALLY SPONSORED RESEARCH OR DEVELOPMENT

Not applicable.

BACKGROUND OF THE INVENTION

1. Field of the Invention

The invention relates generally to the field of subsurface safety valves used in wellbores. More specifically, the invention relates to magnetically sprung, magnetically geared valve actuation devices for use with such safety valves.

2. Background Art

Wellbore valves, such as subsurface safety valves, are used for controlling flow within a well tubing string suspended within a wellbore. Typically, valves of this type include a valve member that is pivotally mounted within the bore of a tubular body disposed within the well tubing string, for movement between open and closed positions. The valve member is urged by a spring to its closed position, but is arranged to be moved to the open position in response to the supply of hydraulic fluid pressure from a remote source at the Earth's surface. The hydraulic fluid pressure acts on a piston forming part of or associated with the valve member. Ordinarily, the valve member is arranged to close automatically under the force of the spring in response to the exhaust of such hydraulic fluid pressure, for example, in the event of failure of a monitored condition in or about the well.

Many such valves are tubing safety valves wherein the body of the valve is disposed within the well tubing string for controlling flow therethrough. Such a valve may be of a type in which the valve body is retrievable from within the tubing string, or in which the body is connected as part of the tubing string—i.e., tubing mounted. Typically, the valve is a flapper pivotally mounted in the bore of the valve body and arranged to be moved to the open position by a flow tube with which the piston is cooperates to move the flow tube within the bore. Thus, the supply of hydraulic fluid pressure lowers the flow tube to force the flapper to the open position. The spring acts on the piston to raise the flow tube and thus permit the flapper to close upon the exhaust of hydraulic fluid pressure on the piston.

U.S. Pat. No. 3,799,258 shows a typical tubing mounted valve of this type wherein the piston is an annular piston disposed about the flow tube within an annular pressure chamber between the flow tube and valve body. The piston urged to its closed position, enabling the flapper to close, by means of a coil spring compressed between the valve body and the flow tube. However, when valves of this type are installed at great depths, it is difficult for a coil or similar metal spring of acceptable size and strength to overcome the hydrostatic head of the hydraulic fluid in the control line leading to the pressure chamber, and thus raise the flow tube to permit the flapper to close.

U.S. Pat. No. 4,161,219 describes one proposed way to solve this problem by the use of piston which, as compared with the annular piston shown in U.S. Pat. No. 3,799,358, is disposed within a cylinder formed in the valve body to one side of the flow tube and is engageable at its lower end with the flow tube to move it to its lower position in response to supply of the hydraulic fluid to the cylinder. Thus, it was thought possible to reduce the cross-sectional area of the piston, and thus the downward force on the flow tube due to the hydrostatic pressure of the control fluid. The force reduction was believed sufficient to enable the flow tube to be raised, and thus permit the flapper to close upon exhaust of the control fluid, using a smaller coil spring than was previously required.

As there is a significant area change between concentric or annular pistons and side pistons at intermediate depths, the designer is faced with the decision of using multiple pistons or weaker springs. Multiple pistons are expensive and weaker springs are less safe. Moreover, metal springs are subject to fatigue and possible failure. The spring(s) must be able to survive and operate correctly over a period of as long as 20 years. There continues to be a need for wellbore valves that overcome some of the limitations of valve structures known in the art.

SUMMARY OF THE INVENTION

One aspect of the invention is a wellbore valve. A wellbore valve according to this aspect of the invention includes a valve operator arranged to move axially along an interior of the wellbore, the valve operator arranged to operate a valve. A valve actuator is disposed proximate the valve operator. The valve actuator is arranged to move from one longitudinal position to another. A linear magnetic gear is coupled at an input element thereof to the valve actuator. The gear is coupled at an output element thereof to the valve operator such that motion of the valve actuator is transferred to the valve operator.

Other aspects and advantages of the invention will be apparent from the following description and the appended claims.

DETAILED DESCRIPTION

A wellbore valve such as a subsurface safety valve according to the various aspects of the invention may operate according to well known principles for such valves. See, e.g., U.S. Pat. No. 5,358,053 issued to Akkerman, which describes a subsurface safety valve having a particular metal spring structure. In embodiments of a subsurface safety valve according to the invention, an actuating mechanism that is arranged to open and close the valve may be magnetically coupled to a valve operator using a linear magnetic gear. Using a linear magnetic gear enables the use of a low-force, long stroke linear actuator to move a high-force short stroke valve actuator. The linear magnetic gear also eliminates the need to provide any seals between the actuator, valve operator and the moving components of the valve itself.

Figure 1:
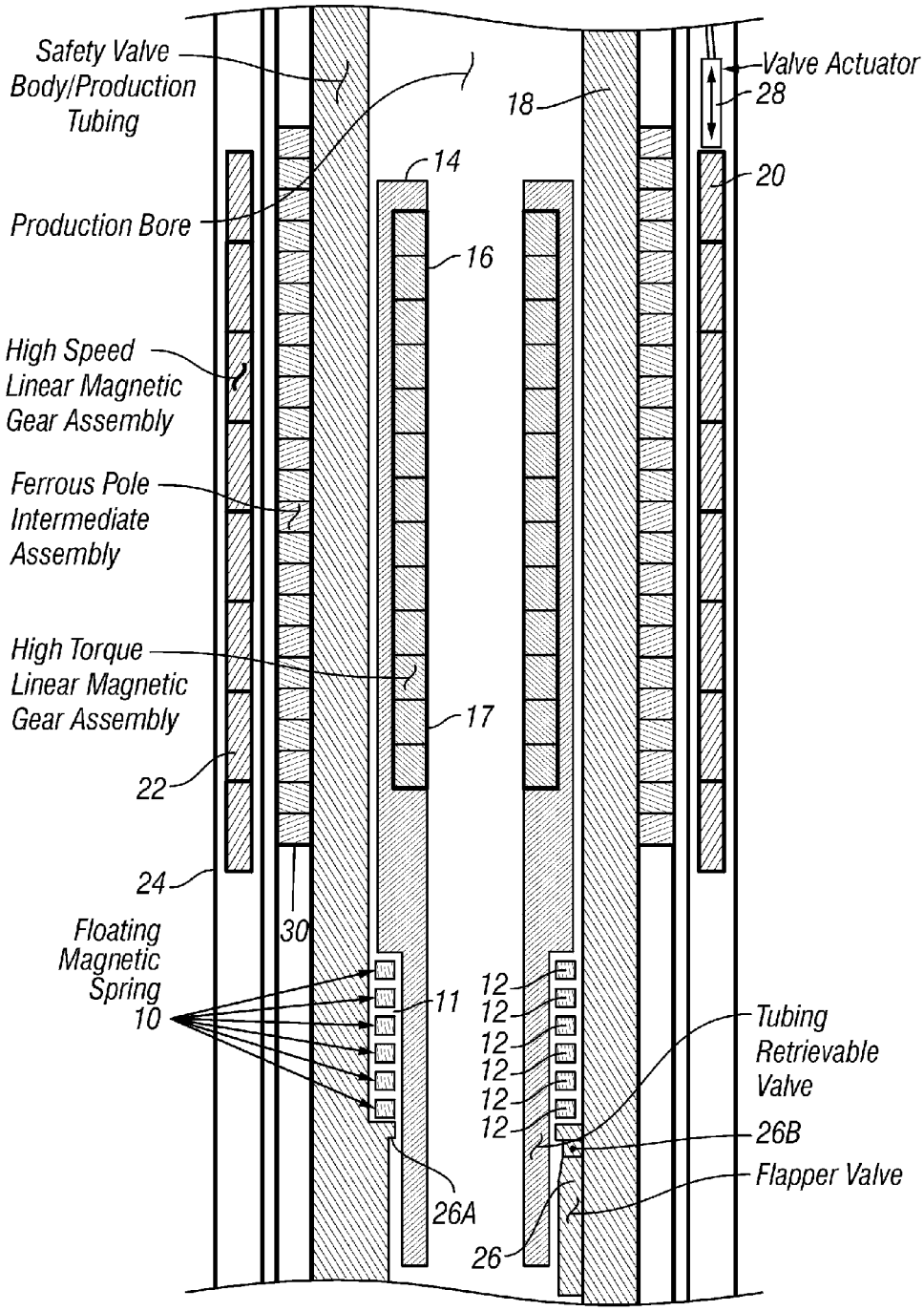
FIG. 1 shows one embodiment of a magnetically sprung, magnetically geared subsurface safety valve.

FIG. 1 shows a cross section of one embodiment of a subsurface safety valve assembly according to the various aspects of the invention. The safety valve assembly, which includes a movable valve operator 14 and a flapper valve 26, is disposed at a selected position along a string of wellbore tubing 18. The tubing 18 is disposed within a casing 24. The tubing 18 and casing 24 can be according to any type well known in the art as used in the construction of wellbores drilled through the Earth's subsurface. In the present embodiment, the valve operator 14 can move axially along the inside of the tubing 18. When the valve operator 14 is moved a sufficient distance upward in the tubing 18, the flapper valve 26 will be urged against its seat 26A by rotating about a pivot 26B. Typically the flapper valve 26 is urged to rotate about the pivot 26B by a spring (not shown).

As will be appreciated by those skilled in the art, the valve operator 14 is engaged with an actuating mechanism, which will be explained below as it relates to the invention, such that the actuating mechanism moves the valve operator 14 downwardly to open the flapper valve 26. In the event of loss of wellbore pressure, change in a monitored parameter, emergency, or other event for which the safety valve is designed to close, the valve operator 14 is moved upwardly by a spring or similar biasing device, such that the flapper valve 26 can close against its seat 26A. Typically, subsurface safety valves are designed such that failure of the actuating mechanism causes the valve actuator to move upwardly, enabling the flapper valve to close.

In the present invention, spring force can be provided to move the valve actuator upwardly by a magnetic spring 10. The magnetic spring 10 may be assembled from a plurality of short, annular cylindrically shaped permanent magnets 12. The permanent magnets 12 are each polarized along its cylindrical axis, and are arranged or "stacked" in as shown in FIG. 1, preferably in alternating magnetic polarity. The magnets 12 are disposed in an annular recess 11 provided between the tubing 18 and the valve operator 14. Because the magnets 12 are arranged in alternating polarity, they repel each other, providing force, coupled through a linear magnetic gear as will be further explained, to urge the valve operator 14 upwardly. By using a sufficiently large number of magnets 12, it is possible to move the valve operator 14 upwardly a substantial axial distance from its lowermost position, that is, wherein the magnets 12 are proximate to or in contact with each other, while opening only a relatively small longitudinal space between each of the magnets 12. For example, 100 magnets stacked as shown in FIG. 1 would enable motion of the valve operator by 10 centimeters, while at such distance, only 0.1 centimeter space would exist between each magnet. Such arrangement would provide substantial biasing force over the entire range of motion of the valve operator 14. The magnets 12 are preferably made from samarium cobalt or similar permanent magnet material that is able to withstand high temperatures without substantial loss of magnetic field strength.

The actuating mechanism in the present embodiment includes a valve actuator 28, which can be an electrically operated linear actuator, an hydraulic cylinder, or other linear actuation device. A linear electric actuator may have advantages over hydraulic cylinders, including eliminating the well known problem of hydrostatic head of hydraulic fluid acting against the cylinder in a downward direction (the force of which must be overcome by the spring to close the valve). In the present embodiment, the valve actuator 28 may be a low-force, high-stroke (long range of movement) device. Such a device may provide the advantage of requiring relatively limited electric power to move the actuator 28 from one endmost position to the other. In the present embodiment, motion of the valve actuator 28 is transformed to high-force, low-stroke linear motion at the valve operator 14 by a linear magnetic gear.

The linear magnetic gear includes an input element, shown at 20 and coupled the valve actuator 28 within an annular space between the casing 24 and the tubing 18. Motion of the valve actuator 28 is directly coupled to the input element 20. A stationary pole element 30 may be affixed to the exterior of the tubing 18 or the interior of the casing 24, and includes a number of pole elements. The stationary pole element 30 is affixed to a part of the tubing so as to remain substantially in place. An output element 16 of the linear magnetic gear may be affixed to the interior of the valve actuator 14. The inner surface of the output element 16 may be covered by a high-strength, non-magnetic metal sleeve 17 to enable fluids to move through the interior of the valve operator 14 without damaging the active components of the output element 16. It is preferable that the valve operator 14 and the tubing 18, at least proximate the safety valve, are made from high strength non magnetic alloy such as monel.

The linear magnetic gear, comprising the input element 20, stationary pole element 30 and the output element 16 enables coupling motion of the valve actuator 28 to the valve operator 14 without the need to provide pressure sealing passages through the tubing 18 or valve operator 14. The linear magnetic gear also enables transforming a long stroke, low force motion of the valve actuator 28 to a high-force, low stroke motion of the valve operator 14.

Figure 2:
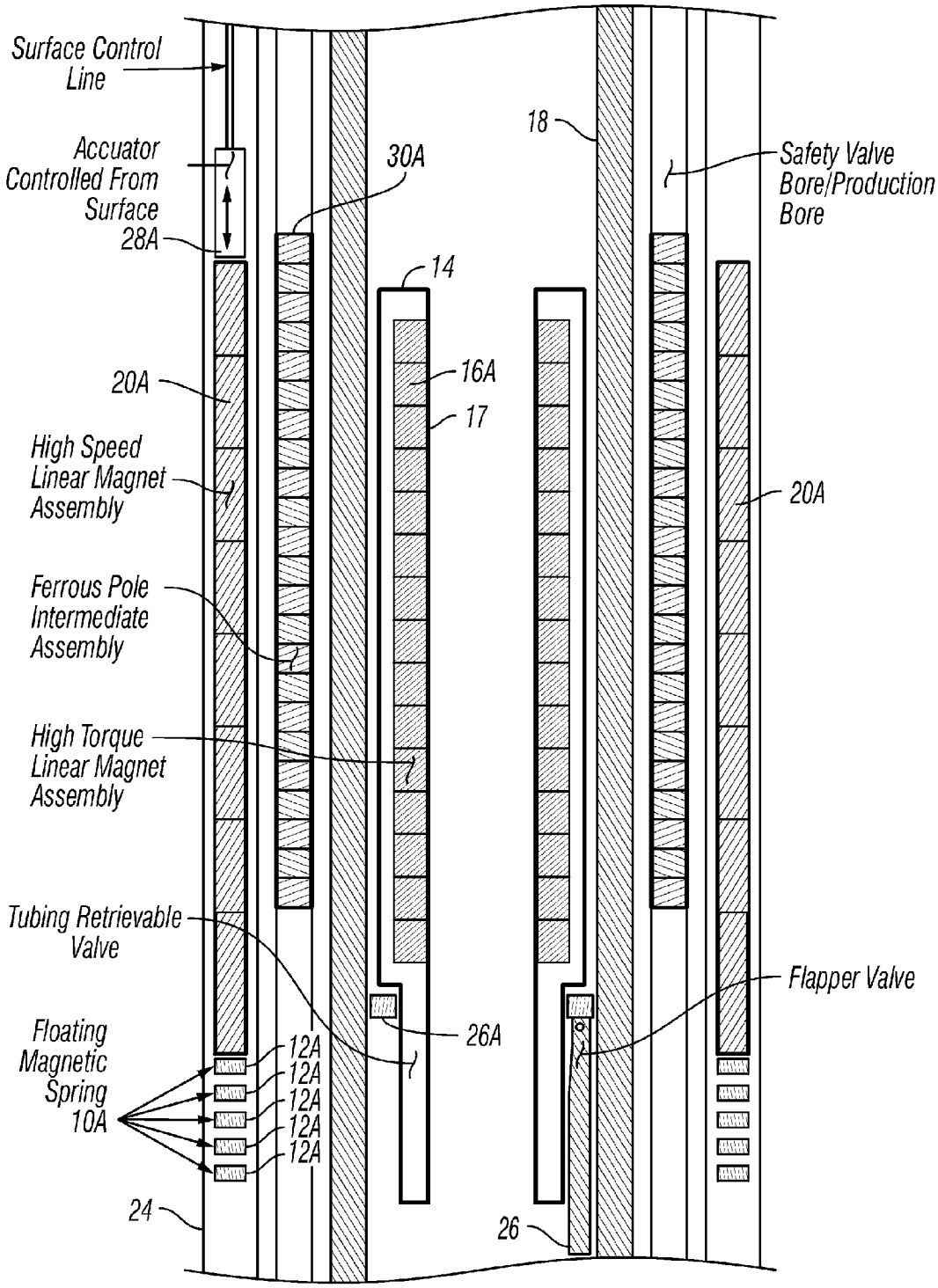
FIG. 2 shows another embodiment of a safety valve.

An alternative arrangement of a safety valve is shown in cut away view in FIG. 2. The valve includes a valve operator 14, flapper valve 26, valve seat 26A arranged to selectively close the well tubing 18, just as in the previous embodiment. Operation of the valve operator 14 is effected by a linear magnetic gear, which in the present embodiment includes an input element 20A moved axially along the outside of the tubing 18 and inside the well casing 24 by a valve actuator 28A. The valve actuator 28A may be any type known in the art and as explained with reference to FIG. 1. A stationary pole element 30A is disposed laterally between the input element 20A and an output element 16A. The output element 16A is affixed to the valve operator 14 similarly to the embodiment explained with reference to FIG. 1. The output element 16A may be covered by a non-magnetic metal alloy shield 17 as in the previous embodiment to avoid contact with well fluids.

In the present embodiment, downward movement of the input element 20A by the valve actuator 28A is opposed by a magnet spring 10A. The magnet spring 10A may be formed from short, annular cylindrically shaped magnets, polarized longitudinally and arranged in alternating polarity, as in the embodiment explained with reference to FIG. 1. Having the magnet spring 10A arranged as shown in FIG. 2 may reduce the exposure of the magnet spring 10A to well fluids, thus prolonging its useful lifetime.

Figure 3:
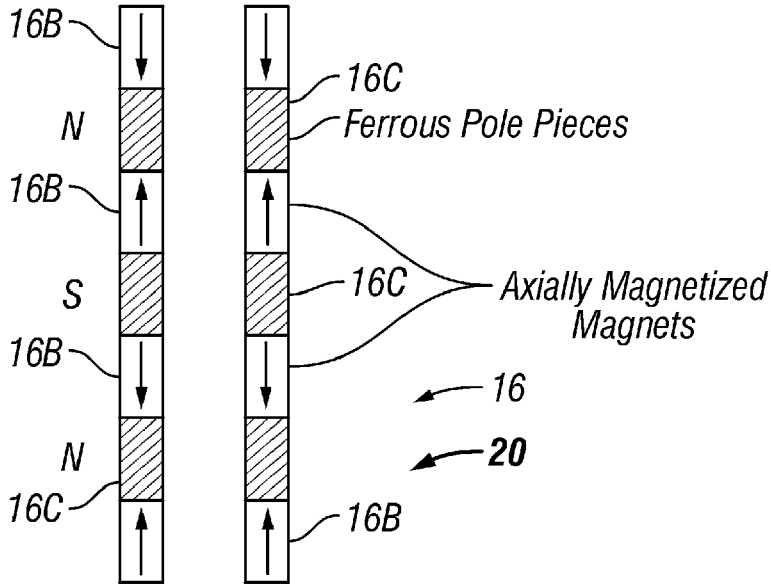
FIG. 3 shows one embodiment of an input element or an output element of a linear magnetic gear.

Having shown generally the arrangement of components of a subsurface safety valve using a magnet spring and a linear magnetic gear, various embodiments of the linear magnetic gear elements will now be explained with reference to FIGS. 3 through 7. FIG. 3 shows one possible embodiment of the output element 16 or the input element 20. According to the present embodiment, the input element 16 or the output element may include annular cylindrically shaped magnets 16B alternately polarized long the longitudinal axis of the element 16, 20 as shown by the arrows thereon. The magnets 16B may be spaced apart from each other by a pole piece 16C such as can be made from ferrite or similar magnetically permeable material. As previously explained, the magnets 16B and pole pieces 16C are generally in the shape of annular cylinders so as to fit in the appropriate place on the valve operator (14 in FIG. 1).

Figure 4:
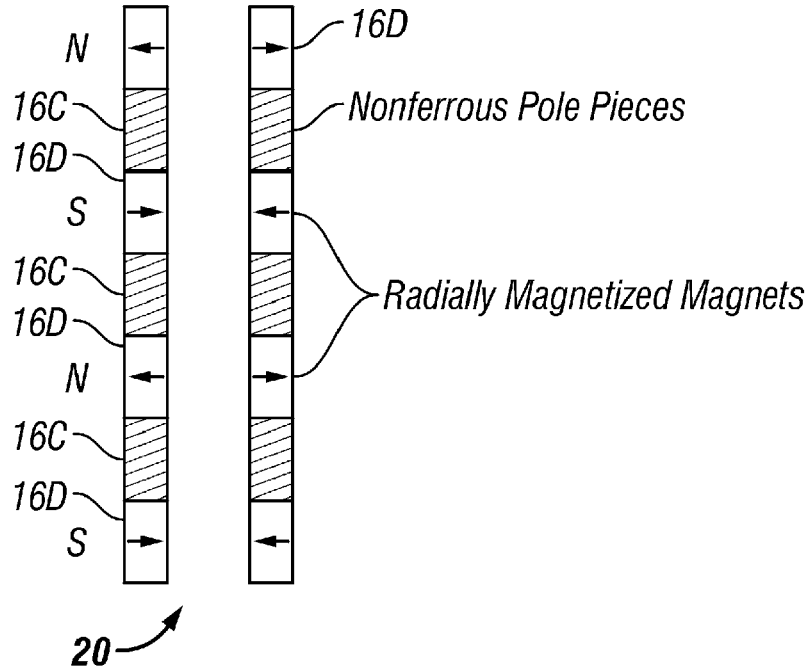
FIG. 4 shows another embodiment of an input element of a linear magnetic gear.

FIG. 4 shows another embodiment of the input element 20. In the embodiment shown in FIG. 4, the input element 20 includes alternating permanent magnets 16D and magnetically permeable pole pieces 16C. The pole pieces 16C may be made from ferrite or similar magnetically permeable material, just as in the embodiment shown in FIG. 3. In the present embodiment, the magnets 16D are radially polarized, as indicated by the arrows thereon, and arranged as shown in FIG. 4 in alternating polarity, such that each successive magnet along the element 20 is polarized in the opposite radial direction as the adjacent magnet 16D.

Figure 5:
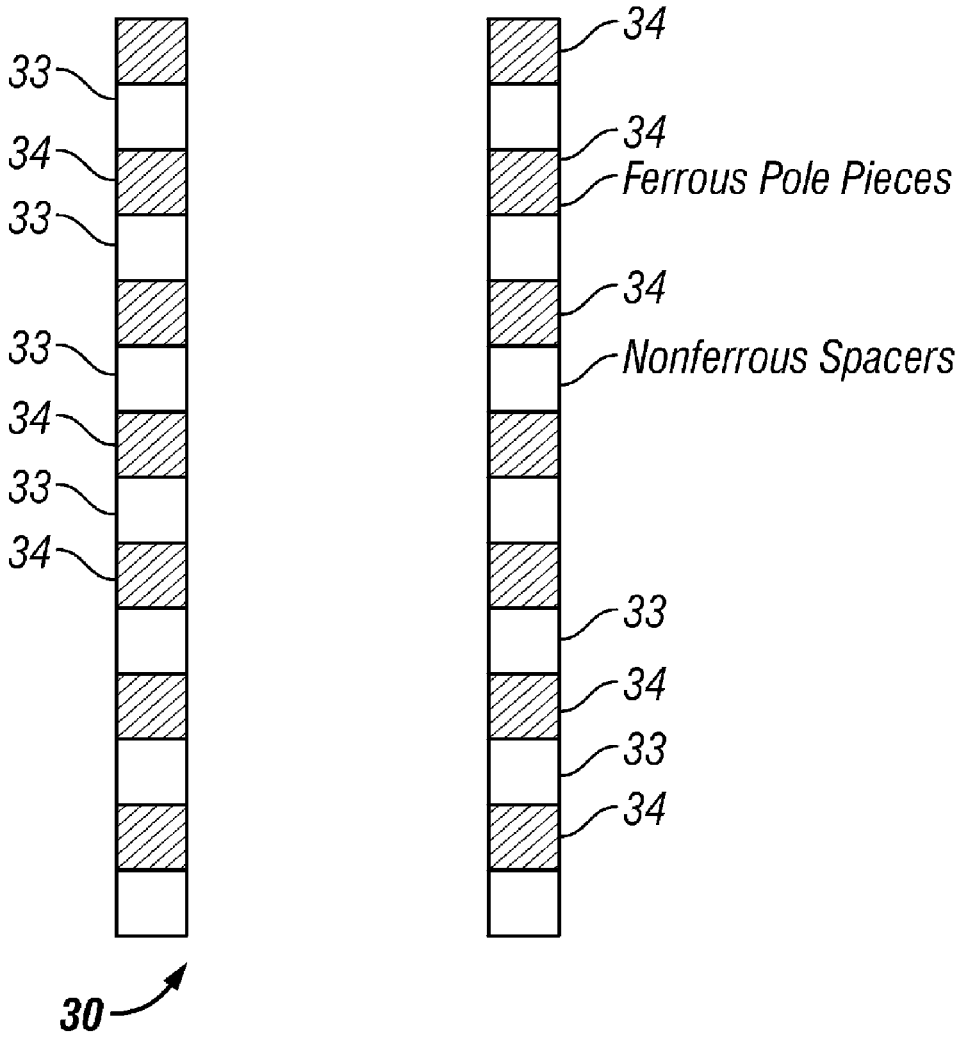
FIG. 5 shows one element of a stationary intermediate element of a linear magnetic gear.

One embodiment of the stationary pole element 30 is shown in FIG. 5. The stationary pole element 30 in the present embodiment may comprise, stacked, alternating non-magnetic elements 33 and magnetically permeable pole pieces 34, such as may be formed from ferrite or similar magnetically permeable material.

Figure 6:
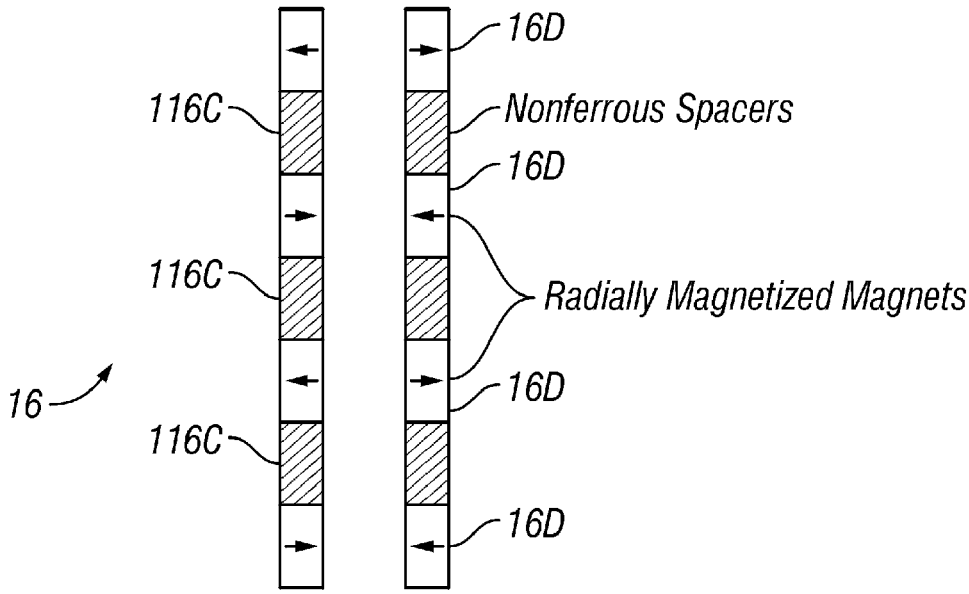
FIG. 6 shows one embodiment of an output element of a linear magnetic gear.

One embodiment of the output element 16 is shown in FIG. 6. The output element 16 may include alternating, radially polarized magnets 16D, and non-magnetic spacers 116C.

Figure 7:
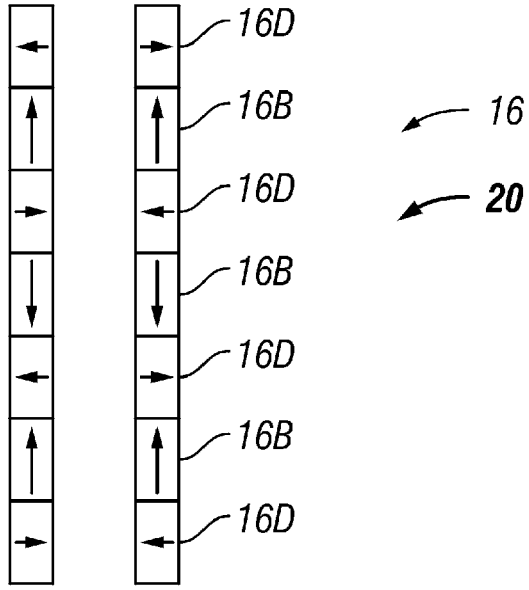
FIG. 7 shows another embodiment of an input element or an output element of a liner magnetic gear.

Another embodiment for either of the input element 20 and output element is shown in FIG. 7, wherein the element includes a quadrature array of magnets. The magnets, shown as longitudinally polarized magnets 16B and radially polarized magnets 16D are arranged such that the polarization direction of each successive magnet is rotated 90 degrees from the polarization direction of the preceding magnet.

By appropriate selection of the longitudinal extent of each of the cylindrical magnets and magnetically permeable pole pieces, and thus the number of such magnets and pole pieces per unit length, on each of the input element, stationary pole element and output element of the linear magnetic gear, it is possible to select the gear ratio of the linear magnetic gear. The gear ratio is the factor by which the input length of movement and force are multiplied and divided, respectively, to obtain the corresponding length of movement and force on the output element. In applications where a low-force, high-movement actuator (28 in FIG. 1) is used to operate a low-movement, high-force valve operator (14 in FIG. 1), the gear ratio will be less than unity. The opposite is the case where a low-movement, high-force actuator is to be gear coupled to a high-movement, low-force valve operator.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A wellbore valve, comprising:

a valve operator arranged to move axially along an interior of the wellbore, the valve operator arranged to operate a valve;

a valve actuator disposed proximate the valve operator, the valve actuator arranged to move from one longitudinal position to another; and a linear magnetic gear coupled at an input element thereof to the valve actuator, the gear coupled at an output element thereof to the valve operator, such that motion of the valve actuator is transferred to the valve operator, the linear magnetic gear configured to have a different amount of movement of the output element with respect to an amount of movement of the input element.

2. The wellbore valve of claim 1, wherein the valve comprises a flapper valve, and the valve operator comprises a sliding sleeve arranged to push the flapper valve open when moved axially along the interior of the wellbore.

3. The wellbore valve of claim 1 further comprising a magnetic spring arranged to move the valve operator so as to close the valve when the valve actuator exerts substantially no actuation force to the input of the magnetic gear.

4. The wellbore valve of claim 3 wherein the valve actuator comprises a mandrel disposed inside a wellbore tubing, and wherein the magnetic spring comprises a plurality of longitudinally polarized, annular cylindrical magnets arranged in alternating polarity and disposed in an annular space between the tubing and the valve operator.

5. The wellbore valve of claim 4 wherein the magnets comprise permanent magnets.

6. The wellbore valve of claim 1 wherein the linear magnetic gear comprises an input element functionally coupled to an output of the valve actuator, a stationary pole element and an output element functionally coupled to the valve operator.

7. The wellbore valve of claim 6 wherein the input element comprises a plurality of alternating cylindrical magnets and magnetically permeable pole pieces, the magnets being longitudinally polarized and arranged in alternating magnetic polarity.

8. The wellbore valve of claim 6 wherein the stationary pole element comprises a plurality of alternating non-magnetic spacers and magnetically permeable pole pieces.

9. The wellbore valve of claim 6 wherein the output element comprises a plurality of alternating cylindrical magnets and magnetically permeable pole pieces, the magnets being longitudinally polarized and arranged in alternating magnetic polarity.

10. The wellbore valve of claim 6 wherein the input element comprises a plurality of alternating cylindrical magnets and magnetically permeable pole pieces, the magnets being radially polarized.

11. The wellbore valve of claim 6 wherein the output element comprises a plurality of alternating cylindrical magnets and magnetically permeable pole pieces, the magnets being radially polarized.

12. The wellbore valve of claim 6 wherein at least one of the input element and the output element comprises quadrature polarized magnets.

13. A wellbore valve, comprising:

a valve operator arranged to move axially along an interior of the wellbore, the valve operator arranged to operate a valve;

a valve actuator disposed proximate the valve operator, the valve actuator arranged to move from one longitudinal position to another; and a linear magnetic gear coupled at an input element thereof to the valve actuator, the linear magnetic gear coupled at an output element thereof to the valve operator such that motion of the valve actuator is transferred to the valve operator, the linear magnetic gear including an input element functionally coupled to an output of the valve actuator, a stationary pole element and an output element functionally coupled to the valve operator, the input element including a plurality of alternating cylindrical magnets and magnetically permeable pole pieces, the magnets being longitudinally polarized and arranged in alternating magnetic polarity.

14. The wellbore valve of claim 13, wherein the valve comprises a flapper valve, and the valve operator comprises a sliding sleeve arranged to push the flapper valve open when moved axially along the interior of the wellbore.

15. The wellbore valve of claim 13 further comprising a magnetic spring arranged to move the valve operator so as to close the valve when the valve actuator exerts substantially no actuation force to the input of the magnetic gear.

16. The wellbore valve of claim 15 wherein the valve actuator comprises a mandrel disposed inside a wellbore tubing, and wherein the magnetic spring comprises a plurality of longitudinally polarized, annular cylindrical magnets arranged in alternating polarity and disposed in an annular space between the tubing and the valve operator.

17. The wellbore valve of claim 13 wherein the input element comprises a plurality of alternating cylindrical magnets and magnetically permeable pole pieces, the magnets being longitudinally polarized and arranged in alternating magnetic polarity.

18. The wellbore valve of claim 13 wherein the stationary pole element comprises a plurality of alternating non-magnetic spacers and magnetically permeable pole pieces.

19. The wellbore valve of claim 13 wherein the output element comprises a plurality of alternating cylindrical magnets and magnetically permeable pole pieces, the magnets being longitudinally polarized and arranged in alternating magnetic polarity.

20. The wellbore valve of claim 13 wherein at least one of the input element and the output element comprises quadrature polarized magnets.

* * * * *